US005865612A

United States Patent [19]

Hill et al.

[11] Patent Number: 5,865,612

[45] Date of Patent: Feb. 2, 1999

[54] HOT SURFACE IGNITOR

[75] Inventors: Bruce L. Hill, Roseville; Rolf L. Strand, Crystal, both of Minn.

[73] Assignee: Honeywell Inc., Minneapolis, Minn.

[21] Appl. No.: 605,258

[22] Filed: Feb. 16, 1996

[51] Int. Cl.[6] ..... F23N 5/00

[52] U.S. Cl. ..... 431/67; 431/258

[58] Field of Search ..... 431/66, 67, 258, 431/6, 75, 25, 27, 46, 78, 80

[56] References Cited

U.S. PATENT DOCUMENTS 2,329,888 9/1943 Eskin et al. ..... 431/67
4,615,282 10/1986 Brown ..... 431/67
4,925,386 5/1990 Donnelly et al. ..... 431/67
4,978,292 12/1990 Donnelly et al. ..... 431/75

*Primary Examiner*—James C. Yeung
*Attorney, Agent, or Firm*—Robert B. Leonard

[57] ABSTRACT

An ignition circuit and method for a hot surface ignitor. The ignition process and apparatus enforces a short warm-up period for the hot surface ignitor where approximately half power is supplied at start-up to the ignitor until the ignitor warms to a point where its impedance is increased. By warming the ignitor gradually, the system power supply is not pulled down to a level which may cause malfunction of other electronics connected to the same supply. Further, the voltage level to the ignitor is controlled so that service life of the ignitor is extended.

3 Claims, 5 Drawing Sheets

HOT SURFACE IGNITOR

BACKGROUND OF THE INVENTION

The present invention is directed to the field of ignition devices for combustible fluids and is more particularly directed to hot surface ignitors.

Ignition systems for combustible fluids are used in many different applications. One well-known application is for ignition of gas in a furnace.

Typically, a temperature sensor measures the temperature of a known space. As shown in FIG. 1, a thermostat 105 may receive a temperature signal from the temperature sensor and compare the temperature value represented by the signal to a stored desired temperature. If the temperature signal is below the desired temperature, the thermostat may cause a furnace 110 to start.

Referring now to FIGS. 1 and 2, the furnace uses an ignition system, such as a hot surface ignitor 112A, to ignite gas in the furnace at start-up. In the past, a relay 112B has closed at start-up of the furnace, the closure causing gas to be released in the furnace and heating of hot surface ignitor. The hot surface ignitor is powered by a power supply 115.

U.S. Pat. No. 4,978,292 issued on Dec. 18, 1990 to Donnelly et al. (the '292 patent) and 4,925,386 issued on May 15, 1990 to Donnelly et al. (the '386 patent) teach modified ignition circuits and methods. In particular, a triac was used in place of the relay in the ignition circuit and a flame detector was used to provide feedback. The triac was switched on and off by a microprocessor. The microprocessor operated to tightly control the operating voltage of the ignitor to the minimum required level which achieved ignition of the gas. The microprocessor would control the power reaching the ignitor by limiting the on-time of the triac. On start-up, an on-time was picked which was more than sufficient to ignite the chosen fuel. At successive start-ups, the on-time was shortened until the flame detector did not detect flame on a particular start-up. The on-time was then lengthened back to a point which was known to cause a flame.

Still, a problem existed with using even a triac in the switching of the ignitors in which their impedance increases as their temperature increases. This is true in silicon nitride ignitors in particular. When the ignitor is cold, its resistance is very low. This resistance increases as the ignitor warms. When the relay closed and energized the cold ignitor, a large load appeared on the system transformer. The shaded area of FIG. 2A represents the on time of the hot surface ignitor compared to the supply voltage (which is 100% here). This temporarily pulled down the system transformer output voltage which occasionally caused low voltage-related problems for other components connected to the system transformer.

SUMMARY OF THE INVENTION

The present invention is an apparatus and method for controlling the warming of a hot surface ignitor. The invention includes a solid state switch controlled by a phase control. In operation, the solid state switch is connected to the hot surface ignitor, the system transformer and the phase control.

At start-up, the phase control causes the solid state switch to close only for the time between a positive or negative peak of the system transformer signal to the next zero crossing. By limiting the power draw of the hot surface ignitor to this time frame, the system transformer voltage drop is minimized without significantly extending the time required to heat the hot surface ignitor to an ignition temperature.

In one embodiment, the hot surface ignitor may be energized at different power levels. A signal conditioning circuit and an analog-to-digital (A/D) converter are used to convert the input voltage to a digital representation for use by the processor to determine which hot surface ignitor power level to use. The solid state switch is located in series with the hot surface ignitor and is turned on just after the peak of the line voltage for each half of the AC line cycle during a three-second warm-up period. The warm-up period increases the hot surface ignitor resistance before full power is applied. After the warm-up period, the solid state switch on-time is increased to obtain the power level determined by the A/D converter. If a flame is not present after a predetermined amount of time, the ignitor is turned off.

DESCRIPTION OF THE PREFERRED EMBODIMENT

Figure 1:
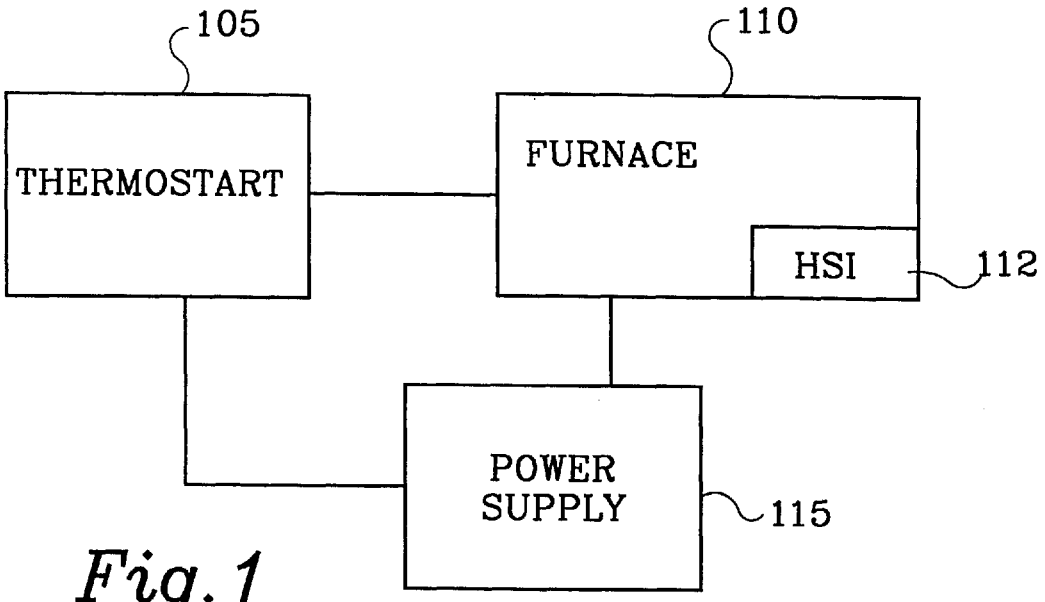
Fig. 1 (PRIOR ART)
FIG. 1 is a block diagram of a prior art furnace system.
Figure 2A:
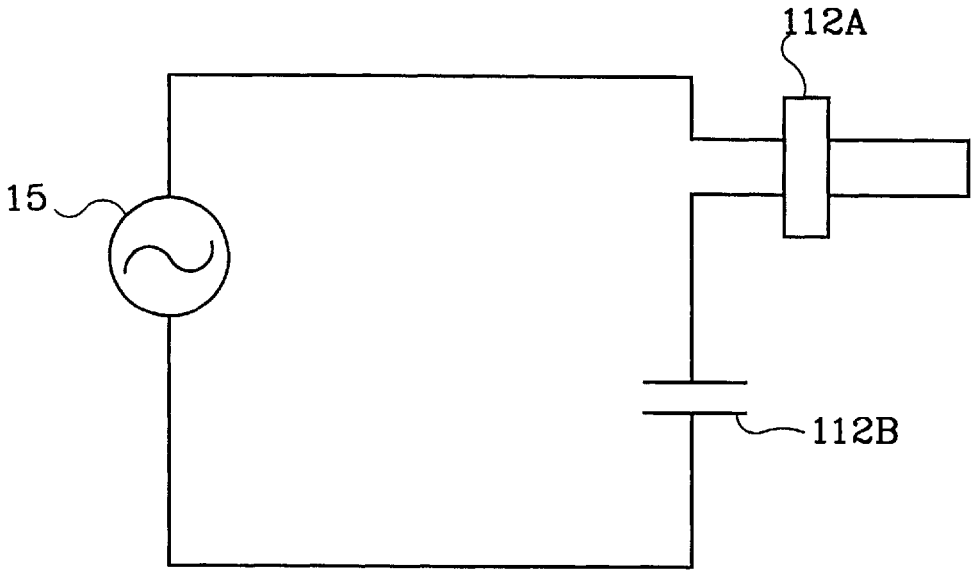
Fig. 2A (PRIOR ART)
FIG. 2A shows a graph of the hot surface ignitor on-time using a prior art ignition circuit.
Figure 2:
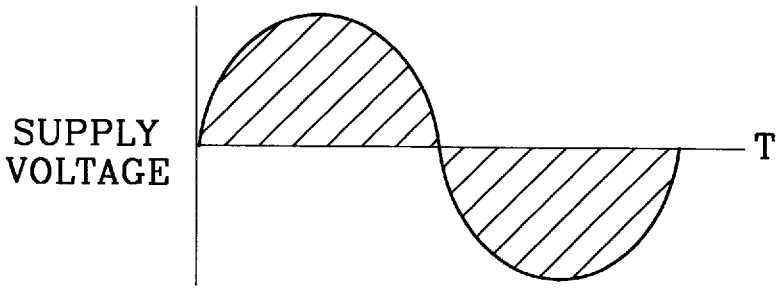
Fig. 2 (PRIOR ART)
FIG. 2 is a prior art block diagram of a furnace ignition system.
Figure 3A:
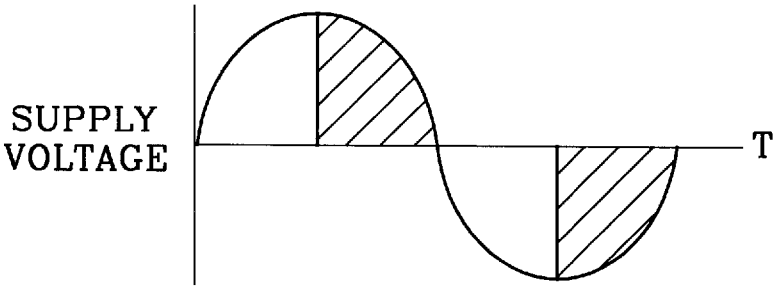
FIG. 3A shows a graph of the hot surface ignitor on-time using the inventive ignition circuit.
Figure 3:
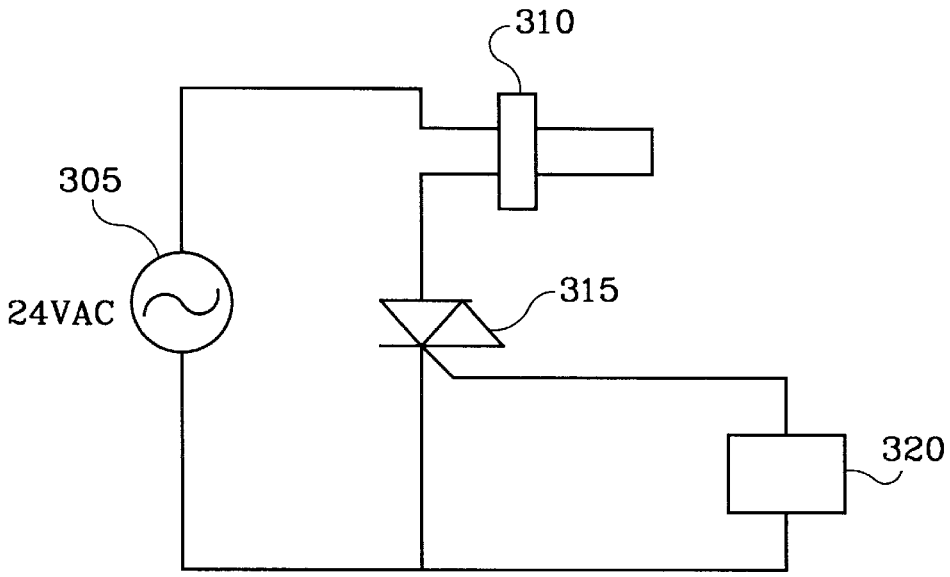
FIG. 3 is a block diagram of the inventive ignition circuit.

Referring now to FIG. 3, thereshown is a schematic diagram of one possible implementation of the invention. The circuit includes a power supply 305, a hot surface ignitor 310, a triac 315, a phase control 320, and a resistor 325. In operation, the power supply 305 is used to supply many functions of the furnace. Normal operation of the power supply produces a 24-volt, 60 Hz power signal. In particular, it provides power to the hot surface ignitor 310. Here the hot surface ignitor is a silicon nitride ignitor such as a Norton 22 V mini HSI. Triac 315 controls the power flow to the hot surface ignitor by restricting or allowing electrical current to flow back to the power supply in response to a control signal produced by the phase control 320. Resistor 325, which here is a 1K ohm resistor, cooperates with the phase control to turn the triac 315 off.

Figure 4:
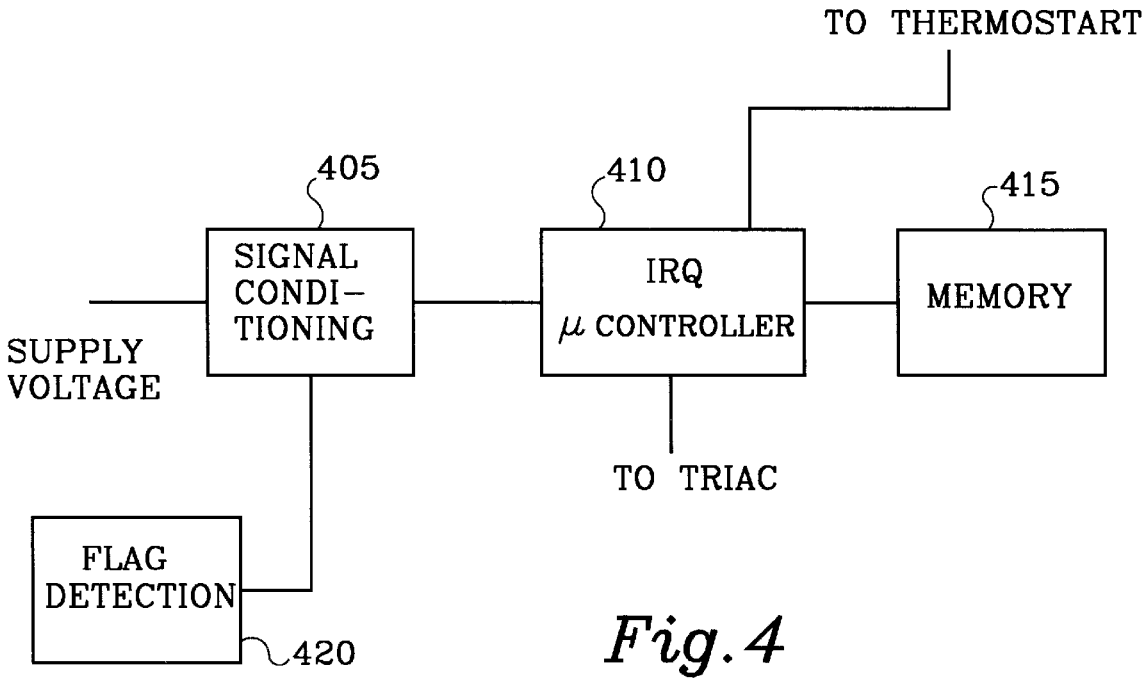
FIG. 4 is a schematic diagram of the phase control of the inventive ignition circuit.

Referring now to FIG. 4, thereshown is a block diagram of the phase control 320. The phase control 320 includes a signal conditioning circuit, a microprocessor 410, memory 415 and flame detector 420. In operation, the microprocessor is connected to the thermostat and receives a call for heat which initiates the process. At start-up, the microprocessor, which is also connected to the solid state switch, turns the solid state switch on just after the positive and negative peaks of the supply voltage for a predetermined amount of time. FIG. 3A shows the on time of the hot surface ignitor as the shaded region This causes a gradual warming of the hot surface ignitor resulting in an increased resistance across the hot surface ignitor. The gradual warming of the hot surface ignitor prevents the pulling down of the supply voltage. In the present embodiment, the predetermined time was chosen to be three seconds. This time period was chosen because the impedance vs. temperature curve of the selected hot surface ignitor showed that the impedance of the ignitor after three seconds was sufficiently high to prevent the pull-down of the power supply voltage to a level which would affect other devices connected to the power supply.

As a further enhancement, the phase control may be used to limit the power used by the hot surface ignitor to only that necessary for gas ignition. This helps extend the lifetime of the hot surface ignitor. To accomplish this, the signal conditioning circuit is connected to the supply voltage and the microprocessor. The signal conditioning circuit produces a square wave signal which is converted to a digital count signal by an analog to digital converter within the processor. The signal conditioning circuit may include an op amp having a reference voltage with hysteresis. A high threshold and a low threshold are set for producing a square wave output signal which is pulse width modulated in relation to the level of the supply voltage. The square wave signal is supplied to an IRQ (interrupt request) port of the microprocessor.

The microprocessor then checks the logic level of the square wave at a predetermined rate (sample rate) for a predetermined number of times. The sample rate is determined by the desired A/D conversion rate. The number of checks are dependent upon the resolution desired for the A/D count. Here, the rate is one check every 500 μsec and the number of checks is 255. Table I below shows the number of counts for the identified voltage levels using the circuit described herein.

TABLE 1

| Supply Voltage | A/D (Counts) |
|---|---|
| 22 | 191 |
| 24 | 197 |
| 26 | 201 |
| 28 | 205 |
| 30 | 208 |

The microprocessor, which is connected to the memory, then uses a look-up table in the memory to determine what voltage level must be set based upon the number of counts. The look-up table is based upon knowing what temperature the hot surface ignitor will reach at particular voltage levels and what the necessary operating voltage will be in the chosen application. For the present ignitor, the application is natural gas ignition which requires a hot surface ignitor temperature of 1150° C. to ignite. To ensure ignition however, the preferred operating range of the hot surface ignitor is 1250°–1300° C. Operation of the hot surface ignitor above 1400° C. will substantially shorten its lifetime. With these things in mind, and after having run tests on the above noted ignitor, Table 2 shows the hot surface ignitor temperature when running at the identified voltage and with the identified on time.

TABLE 2

| Supply Voltage | Temp With 12/16 On Time | Temp With 14/16 On Time | Temp With 16/16 On Time |
|---|---|---|---|
| 22 | 1058° C. | 1133° C. | 1164° C. |
| 24 | 1127° C. | 1208° C. | 1243° C. |
| 26 | 1193° C. | 1256° C. | 1307° C. |
| 28 | 1251° C. | 1333° C. | 1376° C. |
| 30 | 1307° C. | 1391° C. | 1433° C. |

Note that in Table 2, certain voltage-on-time pairs (those underlined) either do not reach the minimum ignition temperature of 1150° C. or they exceed the maximum 1400° C. temperature for long life. The on-time in sixteenths is referring to a full cycle of the supply voltage. Sixteenths of a full cycle were chosen for the following reasons. At the nominal 500 μsec sample rate there are about sixteen samples in one-half of a line cycle at 60 Hz. The twelve, fourteen and sixteen numerators were chosen to minimize the effects of limited precision math. By calibrating and controlling in this way, a low cost RC oscillator circuit on the microprocessor can be used for timing functions.

Figure 5A:
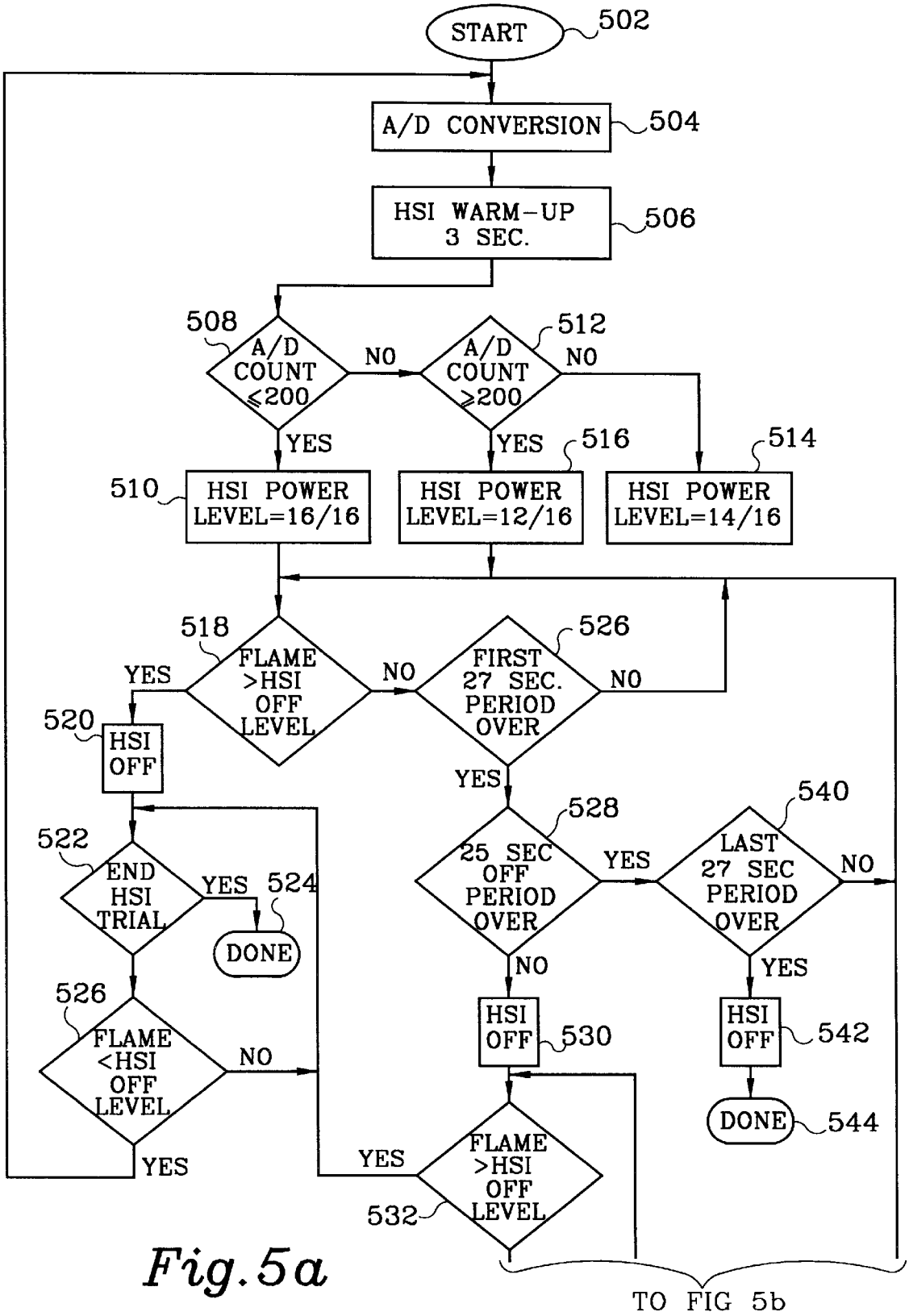
FIG. 5 is a flowchart of the inventive process.
Figure 5B:
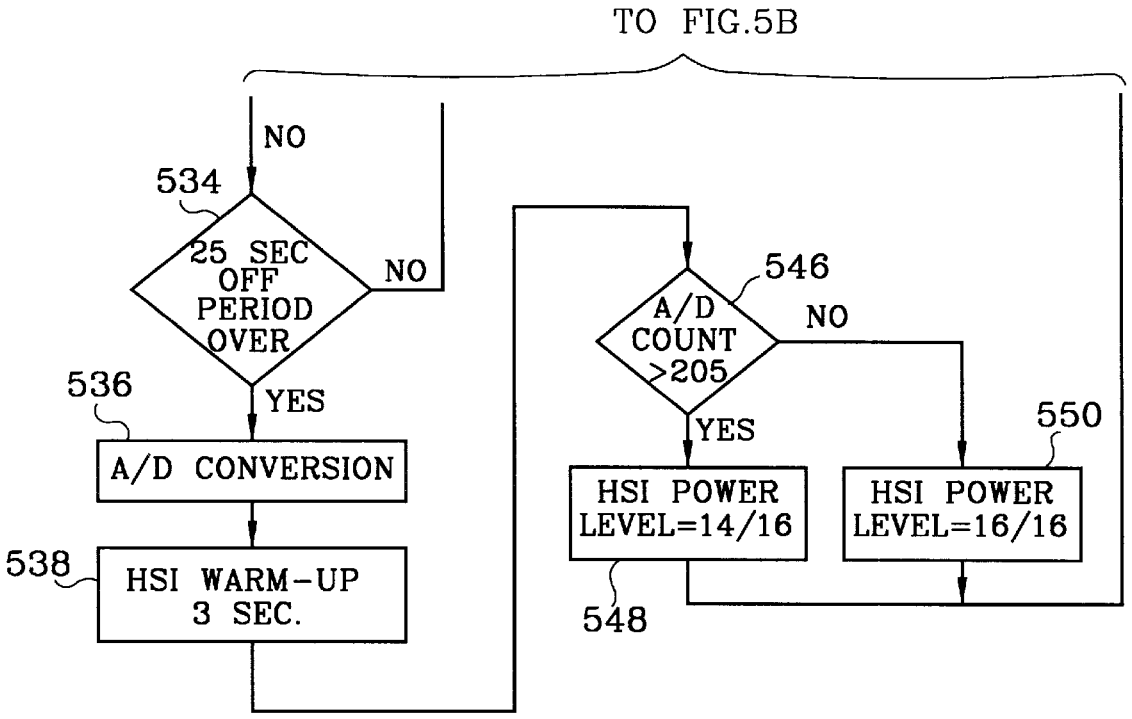

To ensure that the operation of the hot surface ignitor is within a desired temperature range, the microprocessor operates on the process described below in connection with FIG. 5.

After starting at block 502, the process initiates the above-noted A/D conversion at block 504. The process then continues to block 506 where the warm-up period is initiated. After the warm-up is completed, the process then moves to block 508 where a decision is made on whether the count determined by the AID conversion is less than or equal to two hundred. If so, the process continues at block 510 which causes the microprocessor to turn the triac on for 16/16 of the power supply period.

If not, the process moves to block 512 where a determination is made whether the count is greater than two hundred five. If not, the process moves to block 514 where the microprocessor causes the triac to turn on for 14/16 of the power supply period. If so, the process moves to block 516 where the microprocessor causes the triac to turn on for 12/16 of the power supply period.

After the length of on time has been chosen, the process moves on to block 518 where a flame level is detected using flame sensor 420 and compared using the A/D converter and the microprocessor, to a desired flame level (in the preferred embodiment, this is fourteen counts). If the sensed flame level is above the desired flame level, the hot surface ignitor is turned off at block 520. The process then decides in block 522 whether the trial (ignition) period ended. If yes, the process ends at block 524. If no, the process moves to decision block 526 where the process again determines if the flame level is above the hot surface ignitor off level. If yes, the process loops back to block 504. If no, the process moves back to block 522.

If the process determines at block 518 that the flame level is below the off level, the process moves to block 526. This process sets a predetermined on-time limit, here 27 seconds for the hot surface ignitor as shown in block 526. If the time limit has not been reached, the process moves back to block 518. If the time limit has been reached, the process moves on to block 528 where a cool down time is established, here, 25 seconds. If the cool down time is over, the process moves to block 540 and determines if a second 27-second on-time is over. If not, the process loops back to block 518. If so, the process turns the hot surface ignitor off in block 542 and is done at block 544.

If the process determines at block 528 that the off-time is not over, it moves to block 530 where the hot surface ignitor is turned off. The process then moves to decision block 532 where the process again determines if the flame level is above the hot surface ignitor off level. If so, the process moves to block 522. If not, the process again checks to see if the 25 second off-time is over. If not, the process returns to block 532. If so, the process moves to block 536 where an A/D conversion again takes place and then to block 538 where a three-second warm-up begins. After the three-second warm-up, the process moves to decision block 546 where again the process determines whether the count exceeds two hundred five. If so, the process sets the power level at 14/16 and returns to block 518. If not, the process sets the power level at 16/16 and returns to block 518.

The process described in connection with FIG. 5 can be implemented according to the pseudo code below. By using a processor and the code identified below, concurrent task handling is possible. Where used below, the following abbreviations have the following meanings:

HSIOFFLEVEL: is the level at which the A/D conversion of the flame signal is compared in decision blocks 518, 526 and 532.

HSIDRIVELEVEL: the 12/16, 14/16 or 16/16 value for triac on time.

```
Constants:
HSIOFFLEVEL = 14 FlameAtoD Counts
HSI States:
  IdIe
  Warmup 1
  HSI On 1
  HSI Cool Down 1
  Warmup 2
  HSI On 2
  HSI Cool Down 2
HIGHLINE = 205 Power AtoD Counts
MEDIUMLINE = 200 Power AtoD Counts
```

HSI Power Table:

| | Line Voltage | | |
|---|---|---|---|
| HSI State | High | Medium | Low |
| Idle | 0 | 0 | 0 |
| Warmup | 10 | 10 | 10 |
| HSIOn1 | 12 | 14 | 16 |
| HSICoolDown | 0 | 0 | 0 |
| Warmup2 | 10 | 10 | 10 |
| HSIOn2 | 14 | 16 | 16 |
| HSICool Down | 0 | 0 | 0 |

HSITimesTable:

| HSI State | Time Out Seconds |
|---|---|
| Warmup 1 | 3 |
| HSI On 1 | 27 |
| HSI Cool Down 1 | 25 |
| Warmup 2 | 3 |
| HSI On 2 | 27 |
| HSI Cool Down | 25 |

```
Subroutine Zero Cross Service
  Set TimerRate to TimerTick
  Set TimerTick to 0
  If HSIDriveLevel is 16 Then
    If PreviousPhase was Positive Then
      Set HSINegativeOutput to ON
    Else
      Set HSIPositiveOutput to ON
    End If
  End If
  Set PreviousPhase to PhaseInputLevel
End Subroutine
Subroutine One Second Service
  If StartIgnitionSequence is True Then
    Set StartIgnitionSequence to False
    Set IgnitionTimer to 90
  End If
  If IgnitionTimer is greater than 0 Then Decrement IgnitionTimer
  If IgnitionTimer is 0 Then Set HSIState to Idle
  If HSITimer is greater than 0 Then Decrement HSITimer
  If HSITimer is 0 Then
    If HSIState is not Idle Then
      Set HSIState to Next HSI State
      Set HSITimer to HSITimesTable(HSIState)
    End If
  End If
  If HSIDriveLevel is 0 Then
    If PowerAtoD is greater than HIGHLINE Then
      Set LineVoltage to High
    Else If PowerAtoD is greater than MEDIUMLINE Then
```

-continued

```
        Set LineVoltage to Medium
      Else
        Set LineVoltage to Low
      End If
    End IF
    set HSIDriveLevel to HSIPowerTable (HSIState, LineVoltage)
  End Subroutine
  Subroutine 500 microsecond Service
    Increment TimerTick
    If FlameStrength is greater than HSIOFFLEVEL or IgnitionTimer is 0 Then
      Set HSIState to IdIe
    Else If HSIState is Idle and IgnitionTimer is not 0 Then
      Set HSIState to Warmup1
      Set HSITimer to HSITimesTable(HSIState)
    End If
    If HSIDriveLevel is 16 Then
      If TimerTick is greater than 2 Then
        Set HSINegativeOutput to OFF
        Set HSIPositiveOutput to OFF
      End If
    Else If HSIDriveLevel is 0 Then
      Set HSINegativeOutput to OFF
      Set HSIPositiveOutput to OFF
    Else
      Set TurnOnfline to TimerRate – ((TimerRate * HSILevel) / 1.6) + 1
      If TimerTick is equal to TurnOnTime Then
        If PhaseInputLevel is Positive Then
          Set HSIPositiveOutput to ON
        Else
          Set HSINegativeOutput to ON
        End If
      End If
    End If
  End Subroutine
```

The foregoing has been a description of a novel and non-obvious ignition circuit for hot surface ignitors. Many minor variations which fall within the spirit of the invention will become apparent to those of ordinary skill in the art. As an example, a microcontroller may replace the microprocessor and the memory. Accordingly, the specification should not be viewed as limiting the scope of the invention. The inventors define their invention through the claims appended hereto.

We claim:

1. In a fuel combustion device which includes an alternating current power supply providing a supply voltage having a cycle, a hot surface ignitor connected to the power supply, a thermostat and a solid state switch connected to the power supply and the hot surface ignitor, an ignition control circuit, comprising:

a processor connected to the thermostat and the solid state switch, the processor controlling the on and off state of the switch; and memory for storing instructions which control the operation of the processor, the instructions causing the processor to turn the solid state switch on only for a portion of the cycle from just after a peak to a next zero crossing for a predetermined period after start-up.

2. The ignition circuit of claim 1, further comprising:

an analog-to-digital converter connected between the power supply and the microprocessor, the analog-to-digital converter producing a pulse width modulated signal, the pulse width being proportional to the supply voltage and wherein the microprocessor receives the pulse width modulated signal and, based upon the level of the supply voltage, generates a solid state switch drive signal which turns the solid state switch on for a predetermined percentage of the cycle based upon stored voltage level-on time values.

3. The ignition circuit of claim 2, further comprising:

a flame detector connected to the microprocessor, the flame detector producing a signal if a flame is present.

* * * * *